United States Patent [19]

Nakamura et al.

[11] 4,383,510

[45] May 17, 1983

[54] SYSTEM FOR REGULATING THE ENGINE SPEED

[75] Inventors: Hiroyuki Nakamura, Higashiyamato; Makoto Shikata, Musashimurayama; Masaaki Ohgami; Kazuo Hara, both of Musashino, all of Japan

[73] Assignees: Fuji Jukogyo Kabushiki Kaisha, Tokyo; Nissan Motor Co., Ltd., Yokohama, both of Japan

[21] Appl. No.: 240,691

[22] Filed: Mar. 5, 1981

[30] Foreign Application Priority Data

Mar. 7, 1980 [JP] Japan ..... 55-29333

[51] Int. Cl.[3] ..... F02B 3/00

[52] U.S. Cl. ..... 123/352; 123/361; 180/179

[58] Field of Search ..... 123/337, 339, 349, 350, 123/352–356, 361; 180/176, 179

[56] References Cited

U.S. PATENT DOCUMENTS

| | | | |
|---|---|---|---|
| 3,476,205 | 11/1969 | Kato | 123/352 |
| 3,575,256 | 4/1971 | Jania et al. | 123/361 |
| 3,580,355 | 5/1971 | Kitano et al. | 123/352 |
| 3,648,808 | 3/1972 | Kato | 180/176 |
| 3,804,193 | 4/1974 | Ikuta | 123/352 |
| 4,047,507 | 9/1977 | Noguchi et al. | 123/352 |

*Primary Examiner*—Parshotam S. Lall
*Attorney, Agent, or Firm*—Martin A. Farber

[57] ABSTRACT

A system for regulating the engine speed of an internal combustion engine having a carburetor and a throttle valve in the carburetor. The system comprises an electro-mechanical actuator having an electric motor and a push rod engaged with a throttle lever for maintaining the throttle valve to an open state, a speed sensor for detecting the speed of the engine, and an electronic control circuit. A detecting means is provided for producing a pulse train according to the number of the rotations of the electric motor. The electronic control circuit comprises a comparing circuit connected to the speed sensor, a level setting circuit for applying a standard level to the comparing circuit for comparing the output of the speed sensor with the standard level, a counter for counting the output of the detecting means, and a control circuit for producing a pair of output signals in dependency on the outputs of the comparing circuit and of the counter. Output signals of the control circuit are applied to a driving circuit for driving the electric motor for projecting or retracting the push rod, so that the throttle valve is opened or closed in dependency on the output signals of the speed sensor for controlling the engine speed to the standard level.

8 Claims, 15 Drawing Figures

Fig. 5I
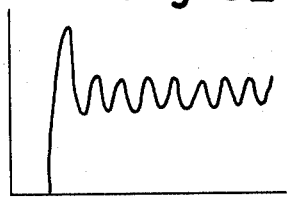
Fig. 5II
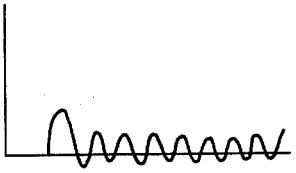
Fig. 5III
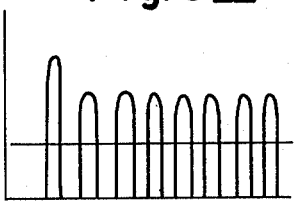
Fig. 5IV
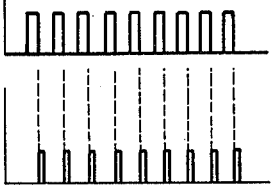
Fig. 5V
FIG. 7
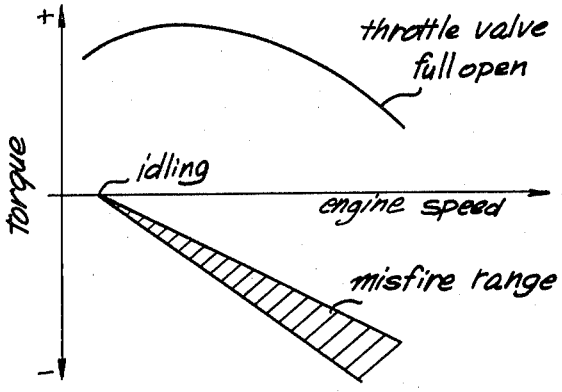

| mode | car speed | engine speed | ignition switch | contact switch |
|---|---|---|---|---|
| 1 | 0 | 0 | OFF | OFF |
| 2 | 0 | 0 | ON | OFF OR ON |
| 3 | 0 | 0 | ON | OFF |
| 4 | 0 | $n_1$ | ON | OFF ⇩ ON |
| 5 | 0 | $n_1$ | ON | ON |
| 6 | over 0 | $n_2$ | ON | ON ⇩ OFF |
| 7 | over 0 | over $n_3$ | ON | OFF |
| 8 | over 0 | $n_2$ | ON | OFF ⇩ ON |
| 9 | over 0 | over $n_3$ | ON | OFF ⇩ ON |
| 10 | 0 | over $n_1$ | ON | ON |
| 11 | over 0 | $n_1$ | ON | OFF ⇩ ON |
| 12 | 0 | below $n_1$ | ON ⇩ OFF | ON ⇩ OFF |

SYSTEM FOR REGULATING THE ENGINE SPEED

BACKGROUND OF THE INVENTION

The present invention relates to a system for automatically regulating the engine speed of an internal combustion engine for automobiles, and more particularly to a system for regulating the idling speed.

The idling speed of the engine is initially regulated to a predetermined set speed in the manufacturing shop. Thereafter, the idling speed increases gradually, because the friction of the engine decreases as the mileage of the automobile increases. Therefore, the idling speed must be regulated to the set speed by operating the regulating screw according to the variation of the idling speed.

SUMMARY OF THE INVENTION

An object of the present invention is to provide a system which automatically regulates the idling speed to a predetermined set speed.

Another object of the present invention is to provide a system for automatically regulating the idling speed which may also have effects of the throttle opener and the dash pot.

According to the present invention, there is provided a system for regulating the engine speed of an internal combustion engine having a carburetor and a throttle valve in the carburetor, comprising an electro-mechanical actuator comprising an electric motor for maintaining said throttle valve to an open state, a speed sensor for detecting the speed of the engine, comparing circuit means connected to the speed sensor, setting circuit means for applying a standard level to the comparing circuit means for comparing the output of the speed sensor with the standard level, detecting means for detecting the number of revolutions of the electric motor, control circuit means for producing a pair of output signals for a time period in dependency on outputs of the comparing circuit means and of the detecting means, driving circuit means for driving the electric motor for increasing and decreasing the open state of the throttle valve in dependency on the output signals of the control circuit means.

Other objects and features of the present invention will become apparent from the following description with reference to the accompanying drawings.

BRIEF DESCRIPTION OF THE DRAWINGS

FIGS. 5 I–5 V shows waveforms at various locations of the brush pulse sensor;

FIG. 7 is a graph showing a range of misfiring of an engine;

DETAILED DESCRIPTION OF THE PREFERRED EMBODIMENTS

Figure 1:
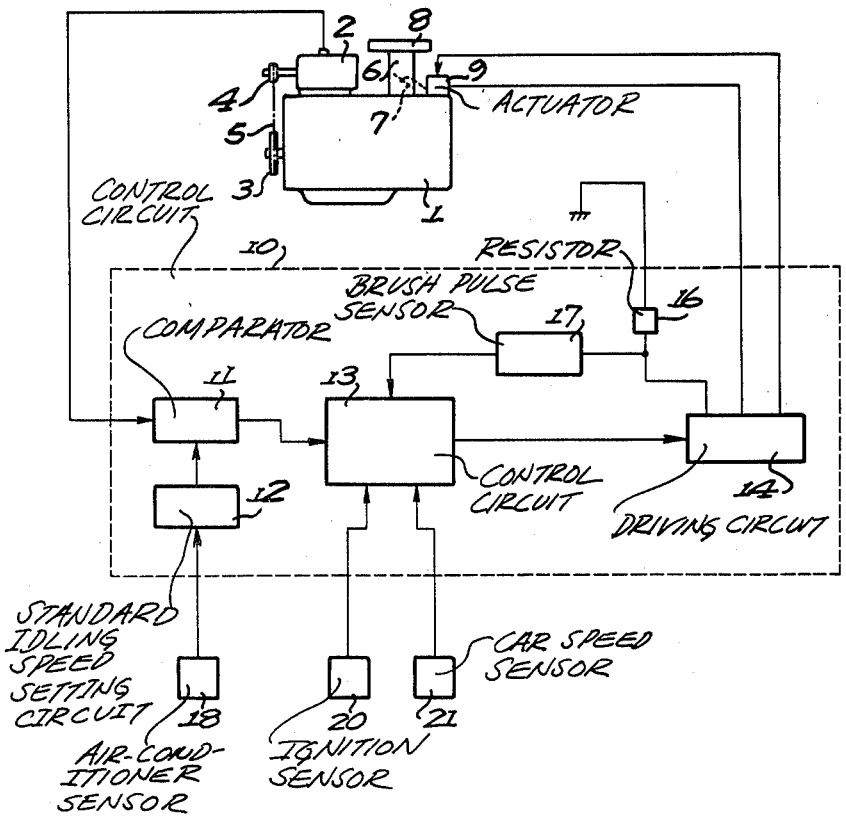
FIG. 1 is a block diagram showing a system of the present invention.

Referring to FIG. 1, an internal combustion engine 1 is provided with a speed sensor 2 which is connected to the crank shaft of the engine by pulleys 3 and 4 and a belt 5. A carburetor 6 has a throttle valve 7 and an air cleaner 8. The shaft of the throttle valve 7 is adapted to be operated by an actuator 9. The output terminal of the speed sensor 2 is connected to a comparator 11 of a control circuit 10.

A standard idling speed setting circuit 12 is connected to the comparator 11 for comparing the idling speed of the engine 1 with the standard idling speed. The comparator 11 is connected to a control circuit 13 which is in turn connected to a driving circuit 14. The driving circuit 14 is connected to the actuator 9 and connected to the ground through a resistor 16. A brush pulse sensor 17 is connected between the driving circuit 14 and the resistor 16. The output of the brush pulse sensor 17 is connected to the control circuit 13.

An air-conditioner sensor 18 for detecting the operation of the air-conditioner is connected to the standard idling speed setting circuit 12. An ignition sensor 20 and a car speed sensor 21 are connected to the control circuit 13.

Figure 2:
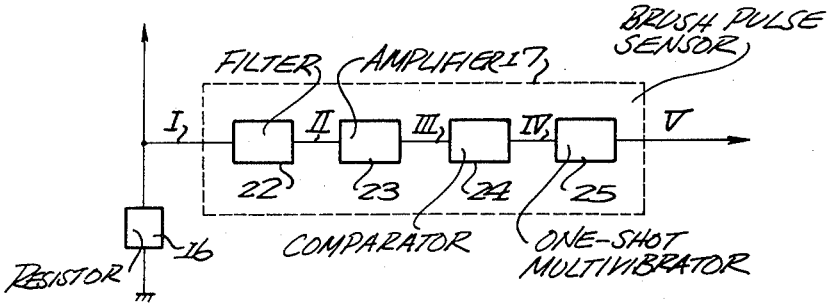
FIG. 2 is a block diagram showing a brush pulse sensor.

Referring to FIG. 2, the brush pulse sensor 17 comprises a filter 22, amplifier 23, comparator 24, and one-shot multivibrator 25 which is connected to a counter 15 (FIG. 10*a*) of the control circuit 13.

Figure 3:
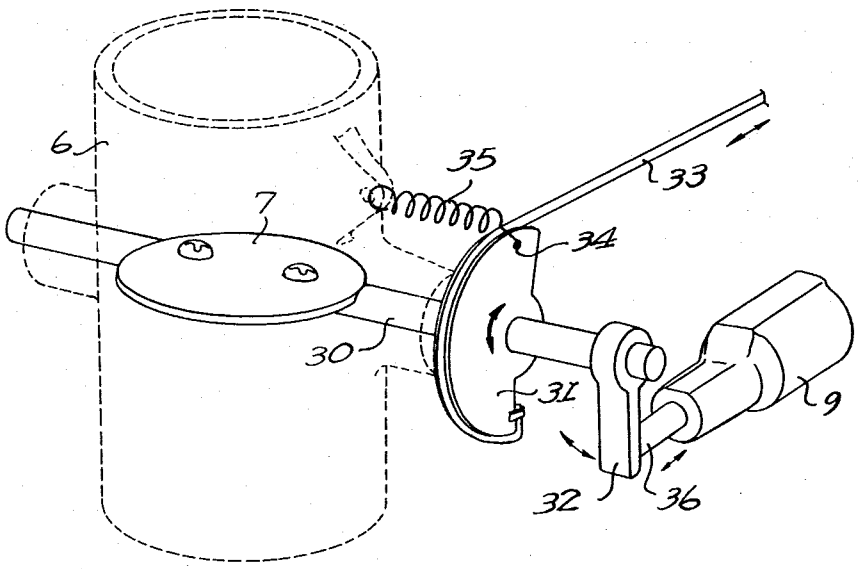
FIG. 3 is a perspective view showing an actuator and a carburetor.

Referring to FIG. 3, throttle levers 31 and 32 are secured to the shaft 30 of the throttle valve 7. The throttle lever 31 is connected to an accelerator pedal through an accelerator cable 33 and biased by a spring 35 connected between a hole 34 and the carburetor body so as to close the throttle valve 7. The lever 32 abuts on the end of a rod 36 of the actuator 9.

Figure 4:
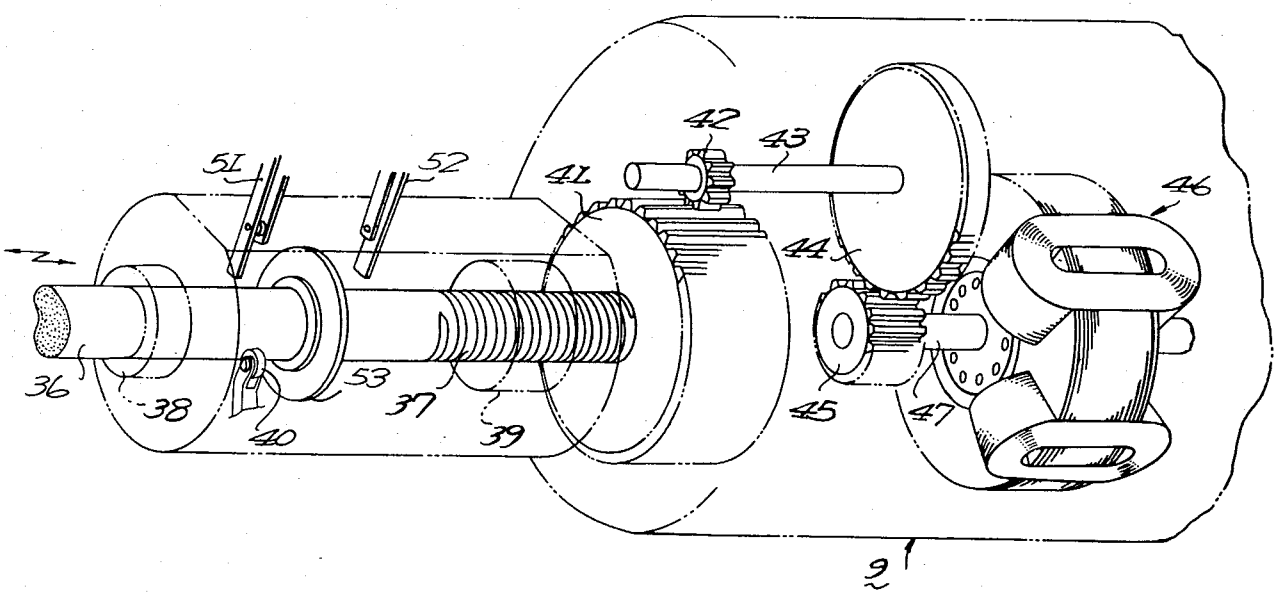
FIG. 4 is a perspective view showing the actuator in detail.

As shown in FIG. 4, the rod 36 is secured to a gear 41 and supported by a bearing 38. The rod 36 has an actuating plate 53 and a screw portion 37 which is threaded into a stationary fixed nut 39. A pair of limit switches 51 and 52 are provided on opposite sides of the plate. A feeder roller 40 is engaged with the rod 36 to feed a current. The gear 41 is made of plastic and the rod 36 is insulated from the housing. Accordingly, when the rod 36 is in contact with the lever 32, the current flows through the rod 36 and lever 32, so that the contact may be electrically detected. The gear 41 engages with a small gear 42 secured to a shaft 43 of a large gear 44. The gear 44 engages with a small gear 45 secured to a shaft 47 of a direct current motor 46.

The motor 46 operates to rotate the shaft 47 in one direction or in the opposite direction according to signals which will be hereinafter described. The rotation of the shaft 47 is transmitted to the rod 36 through gears 45, 44, 42 and 41. The gear 41 always engages the gear 42 since the gear 41 is sufficiently elongated in the axial direction. The rod 36 moves in the axial direction because of the engagement of the screw portion 37 with the nut 39. Thus, the rod 36 projects or retracts by the signals. Projection of the rod 36 causes the shaft 30 of the throttle valve 7 to rotate in the throttle valve open direction. Thus, the engine speed increases. To the contrary, when the rod 36 is retracted, the throttle valve 7 is closed by the spring 35, so that the engine speed decreases.

The plate 53 of the rod 36 actuates to open the limit switch 51 or 52 at the limit stroke end, which means the limitation of the operation of the throttle valve 7 for the idling speed. The switches 51 and 52 are provided disposed in a motor driving circuit for the motor 46. Accordingly, the motor stops on the opening of one of the switches and the operation of the throttle valve 7 stops.

Figure 6:
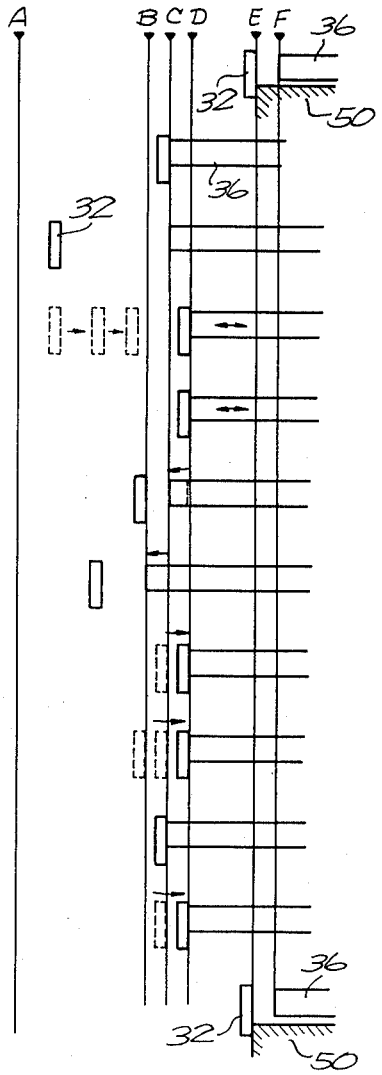
FIG. 6 is a chart showing an operation of the actuator.
Figure 10A:
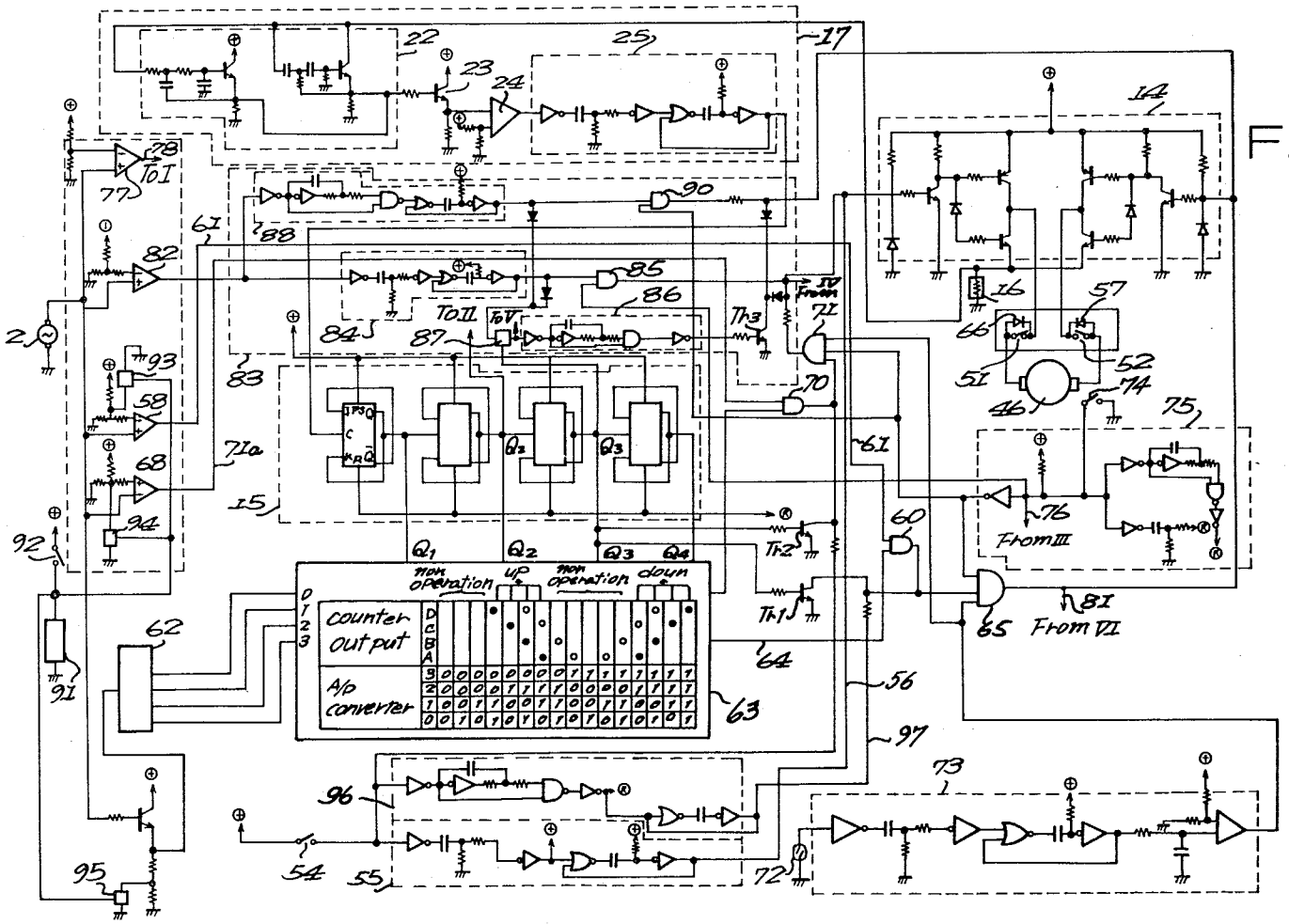
FIGS. 10*a* and 10*b* show an example of the control circuit in the system of the present invention.
Figure 10B:
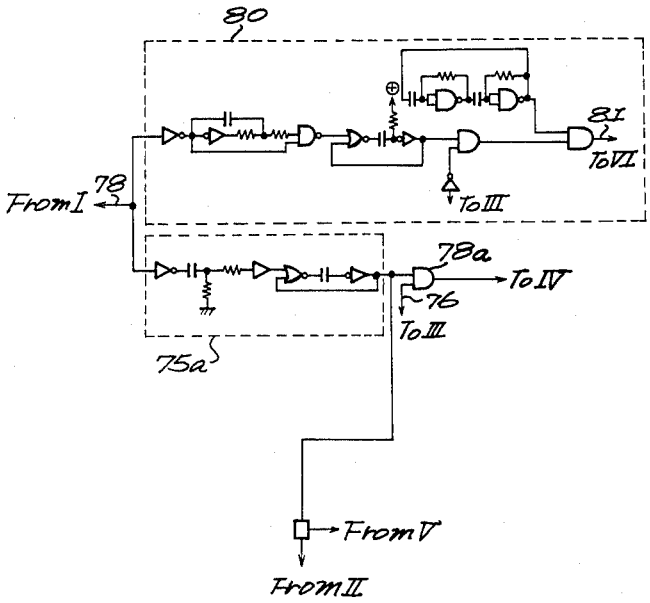

The operation of the system will be hereinafter described with reference to FIGS. 6, 10*a* and 10*b*. When an ignition switch 54 (FIG. 10*a*) is opened, the rod 36 of the actuator 9 is in the retracted position F and the throttle lever 32 abuts on a stopper 50 as shown in FIG. 6. The limit switch 52 is opened by the plate 53. When the ignition switch 54 is closed, a starting circuit 55 operates to produce an output signal for a predetermined time. The signal is applied to the driving circuit 14 by a lead 56 to operate the circuit. A driving current flows through the switch 51, motor 46 and diode 57, so that the motor 46 rotates to project the rod 36. As shown in FIG. 6 at modes 2 and 3, the rod 36 is projected to a position C which is beyond a normal idling position D, whereby the throttle valve 7 is opened greater than the normal idling opening degree for starting the engine. The mode 3 shows the cold engine start condition where a choke valve is closed. Since the throttle valve is opened according to the closing of the choke valve, the lever 32 is spaced apart from the rod 36.

When the engine speed is higher than a predetermined rate $n_1$ in the stopping condition of the car, the output voltage of the speed sensor 2 exceeds a predetermined standard level, so that the output of a comparator 58 changes to a high level. The output is applied to an AND gate 60 by a lead 61. On the other hand, the output of the speed sensor 2 is converted to digital signals by an A/D converter 62 in dependency on the output voltage. The outputs of the A/D converter 62 are applied to a logic circuit 63 having the operation of a truth table.

Describing the operation of the brush pulse sensor 17, the direct current passing through the motor 46 varies according to the variation of the resistance between brushes and slip-rings of the commutator of the motor 46. The variation of the current is detected by the resistor 16 and applied to the brush pulse sensor 17. For example, in the case that the inner resistance of the motor 46 is 20 ohm, the resistance of the resistor 16 is 1 ohm and the current flowing the motor is 0.3 A, the voltage at the resistance 16 is 0.3 V. The variation at the position I in FIG. 2 is shown in FIG. 5 I. The waveform is changed to the waveform of FIG. 5 II by the filter 22. The waveform is further dealt with by the amplifier 23, comparator 24 and one-shot multivibrator 25, so that the waveform is changed as shown in FIG. 5 III, FIG. 5 IV and FIG. 5 V. By counting output pulses FIG. 5 V of the sensor 17, the number of revolutions of the motor 46, that is the amount of the projection of the rod 36 may be detected.

The counter 15 counts the pulses from the brush pulse sensor 17 to produce time signals $Q_1$, $Q_2$, $Q_3$ and $Q_4$ which have different time periods respectively. The time signals $Q_1$ to $Q_4$ are applied to gates in the logic circuit 63 for opening the gates for the respective time period. The logic circuit 63 operates to change the output signal on a lead 64 to a 1 for a time period which is determined by the outputs of the A/D converter 62, that is the idling speed of the engine. Thus, the output of the AND gate 60 goes to a high level which is applied to the driving circuit 14 through an AND gate 65. The driving current flows through the switch 52, motor 46 and diode 66, so that the motor 46 rotates reversely. Thus, the rod 36 is retracted. When the count of the counter 15 reaches a predetermined amount and the output $Q_3$ changes to a high level, a transistor $Tr_1$ becomes conducting. Thus, the AND gate 65 is closed, so that the motor 46 stops. By such an operation, the idling speed is decreased to the standard speed $n_1$.

If the idling speed is lower than the idling speed $n_1$, the output of a comparator 68 changes to a high level which is applied to an AND gate 70 by a lead 71*a*. The output of the AND gate 70 changes to a 1 for a predetermined time by signals from the logic circuit 63 and comparator 68 in a manner similar to the above described operation. The output of the AND gate 70 is applied to the driving circuit 14 through an AND gate 71. Thus, the motor 46 rotates so as to project the rod 36. When the output $Q_3$ of the counter 15 changes to a high lever, a transistor $Tr_2$ becomes conducting. Therefore, the AND gate 71 is closed, so that the idling speed can be controlled to the idling speed $n_1$.

Modes 4 and 5 show such control operations. In the mode 4, the lever 32 rotated together with the choke valve is gradually returned to the position D as the warming up of the engine progresses.

When the car is started and the output of a car speed sensor 72 exceeds a predetermined level, the output of a car speed detecting circuit 73 changes to 0 for a predetermined time thereby closing AND gates 65 and 71. When the throttle valve 7 is opened, the lever 32 separates from the rod 36. Thus, the contact switch 74 composed of the roller 40, rod 36 and lever 32 is opened. The contact switch 74 is connected to a rod projecting circuit 75 for the dash pot. The output on lead 76 of the circuit 75 goes to a high level by the signal of the switch 74. When the engine speed exceeds a predetermined speed $n_2$, an output on a lead 78 of a comparator 77 changes to a high level. Thus, an output of a rod projecting circuit 75*a* (FIG. 10*b*) changes to a high level for a predetermined time, and the output of an AND gate 78*a* goes to a high level, so that the motor 46 is operated so as to project the rod 36 to the middle position C. Mode 6 shows this operation. The Roman numerals in FIGS. 10*a* and 10*b* indicate corresponding connection of the lines; that is the same numeral indicates that those lines are connected to each other.

Figure 8:
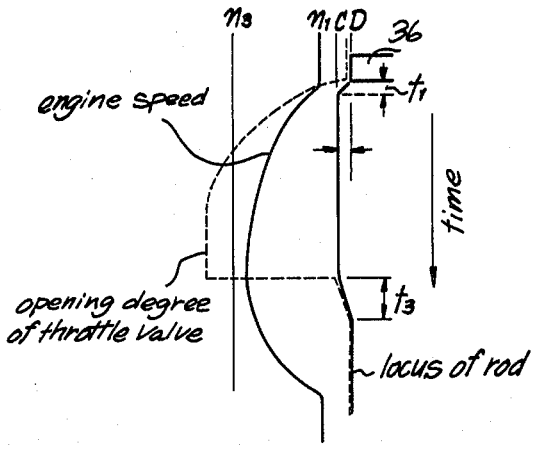
FIGS. 8 and 9 are graphs showing relations between a rod of the actuator, the throttle valve and the engine speed.

When the car speed $n_2$ decreases below the predetermined speed, the output on the lead 78 is inverted. The inverted signal is sent to a rod retracting circuit 80. The circuit 80 produces an intermittent output on a lead 81 for a predetermined time. The motor 46 is intermittently operated, so that the rod 36 is slowly retracted to the position D. Thus, dash pot effect may be provided. Mode 8 of FIG. 6 and FIG. 8 show the dash pot operation.

Figure 9:
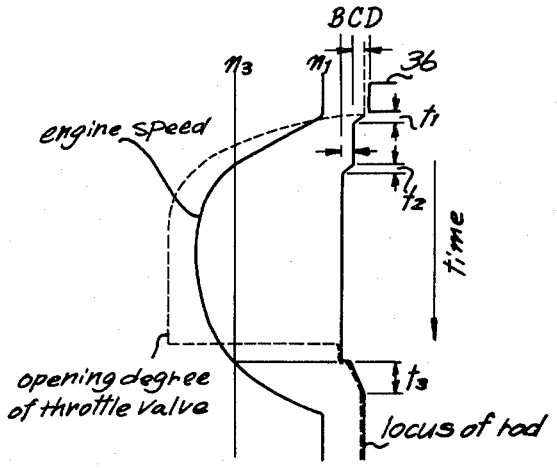

When the engine speed exceeds a predetermined speed $n_3$, an output of a comparator 82 changes to a high level, which is applied to a throttle opener control circuit 83. A rod projecting circuit 84 operates to generate an output signal for a predetermined time. The output signal is applied to an AND gate 85 and to a control circuit 86 through a semiconductor switch 87. The output of the AND gate 85 is applied to the driving circuit 14. Thus, the rod 36 is projected. When the output $Q_3$ changes to a low level, the switch 87 is opened. Thus, the control circuit 86 produces an output, which renders a transistor $Tr_3$ conductive. Therefore, the motor 46 stops and the rod 36 is at the projected position B as shown at mode 7 in FIG. 6. When the engine speed decreases below the speed $n_3$, the output of the comparator 82 is inverted. By such an inversion of the output, a rod retracting circuit 88 of the throttle opener control circuit 83 operates to produce an output for a predetermined time. The output is applied to an AND gate 90 and to the control circuit 86 through the switch 87. Thus, the driving circuit 14 is operated to retract the rod 36. The motor 46 is stopped by the output $Q_3$ and the conduction of the transistor $Tr_3$. Accordingly, the rod 36 is retracted to the position C. Thereafter, by the signal of the contact switch 74, the rod retracting circuit 88 operates to retract slowly the rod 36 to the position D as described above. Mode 9 and FIG. 9 show such a throttle opener effect.

The throttle opener effects to prevent misfiring of the engine. Misfiring occurs in the negative torque condition of the engine, such a condition as where the throttle valve 7 is closed on the descent. FIG. 7 shows the range in which the misfiring will occur. Since the throttle opener keeps the throttle valve 7 in an open condition for a predetermined time at a deceleration, misfiring may be prevented.

Now hereinafter describing the operation for an air-conditioner, the air-conditioner 91 is operated by closing an air-conditioner switch 92. By closing the switch 92, semiconductor switches 93, 94 and 95 are closed, so that each set value of the comparators 58,68 and the A/D converter 62 is raised. Therefore, the motor 46 is operated to project the rod 36 so as to increase the idling speed to a raised level. When the switch 92 is opened, the rod 36 is retracted to the position D. Modes 10 and 11 show such an operation.

When the ignition switch 54 is opened, a running-on preventing circuit 96 operates to produce an output, which is applied to the AND gate 65 by a lead 97. The output of the AND gate actuates the driving circuit 14, so that the rod 36 is further retracted to the initial position F as shown in mode 12. The lever 32 abuts on the stopper 50. Since the rod 36 is separated from the lever 32 and the lever abuts the stopper, the throttle valve is kept in the closed position. Thus, the running-on of the engine may be prevented.

What is claimed is:

1. In a system for regulating the engine speed of an internal combustion engine of the type having a carburetor and a throttle valve in said carburetor, an actuator comprising an electric motor for maintaining said throttle valve in an open state, a speed sensor responsive to the speed of said engine for producing an output, a comparing circuit means for comparing the output of said speed sensor with a reference value and for producing first signals in dependency on the comparison, the improvement comprising first circuit means for being responsive to the number of the revolutions of said electric motor from a reference point during the operation of the motor for producing an output dependent on said number of revolutions, control circuit means for contrasting the difference between the output of said speed sensor and a predetermined reference value with the output of said first circuit means and for producing output signals for a time period until the contrasting reaches a predetermined state, and driving circuit means for driving said electric motor for increasing and decreasing respectively the position of said throttle valve in said open state of said throttle valve in dependency on said output signals of said control circuit means and on said first signals from said comparing circuit means.

2. The system for regulating the engine speed of an internal combustion engine according to claim 1, further comprising a throttle lever operatively connected to said throttle valve, said actuator has a push rod which operatively engages with said throttle lever so as to maintain the throttle valve in said open state.

3. The system for regulating the engine speed of an internal combustion engine according to claim 1, wherein said first circuit means for producing a pulse train in dependency on said number of the revolutions, said control circuit means comprises, a counter for counting the output of said first circuit means, a logic circuit operatively connected to said speed sensor and to said counter, and gate means for being opened in dependency on outputs of said counter and said logic circuit.

4. The system for regulating the engine speed of an internal combustion engine according to claim 3, wherein said control circuit means includes an A/D converter means connected between said speed sensor and said logic circuit for providing said difference between the output of said speed sensor and the predetermined reference value.

5. The system for regulating the engine speed of an internal combustion engine according to claim 1, further comprising a device operatively connected to said throttle valve, ignition circuit means which is connected to an ignition switch of the engine and to said driving circuit means for producing an output for actuating said actuator for increasing opening of said throttle valve in the open state for a predetermined time upon closing of said ignition switch and for producing another output for decreasing the opening of said throttle valve in the open state for a predetermined time upon opening of said ignition switch so as to operate said actuator from said device of said throttle valve.

6. The system for regulating the engine speed of an internal combustion engine according to claim 1, further comprising a device operatively connected to said throttle valve, car speed detecting circuit means for producing an output when the car speed exceeds a predetermined level, contact switch means for detecting separation of said actuator from said device of said throttle valve, dash pot circuit means for producing an output for increasing opening of said throttle valve in the open state for a predetermined time when the engine speed exceeds a predetermined level and said contact switch means detects the separation and for producing an output for slowly closing the throttle valve in the open state when said contact switch means detects contact.

7. The system for regulating the engine speed of an internal combustion engine according to claim 6 further comprising throttle opener circuit means for producing an output for increasing the opening of the throttle valve in the open state for a predetermined time when the engine speeds exceeds a predetermined level which is higher than a level of said dash pot circuit means and for producing an output for decreasing the opening of the throttle valve open state when the engine speed decreases below said predetermined level.

8. The system for regulating the engine speed of an internal combustion engine according to claim 1, further comprising an air-conditioner for a car containing said internal combustion engine, means for changing said reference values for increasing opening of the throttle valve in the open state when said air-conditioner is operated.

* * * * *